US007210811B1

(12) United States Patent
Swanson

(10) Patent No.: US 7,210,811 B1
(45) Date of Patent: May 1, 2007

(54) CEILING MOUNTED SWING ARM LIGHTING APPARATUS

(75) Inventor: Dennis K. Swanson, Chatsworth, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 192 days.

(21) Appl. No.: 11/031,598

(22) Filed: Jan. 6, 2005

(51) Int. Cl.
*F21S 8/00* (2006.01)

(52) U.S. Cl. ..... 362/147; 362/219; 362/404; 362/431

(58) Field of Classification Search ..... 362/147, 362/404, 219, 410, 431, 238, 239, 250, 269, 362/285, 418, 427, 432
See application file for complete search history.

(56) References Cited

U.S. PATENT DOCUMENTS

| | | | | |
|---|---|---|---|---|
| D40,216 | S | 8/1909 | Pitner | |
| 2,041,847 | A * | 5/1936 | Marchand | 248/160 |
| 2,297,781 | A | 10/1942 | Korengold | |
| D136,799 | S * | 12/1943 | Vendope | D26/64 |
| D194,800 | S | 3/1963 | Monroe | |
| 3,240,925 | A | 3/1966 | Paschke et al. | |
| 3,378,678 | A | 4/1968 | De Groff | |
| 4,449,169 | A | 5/1984 | Warshawsky | |
| 4,605,995 | A * | 8/1986 | Pike | 362/287 |
| 4,726,552 | A * | 2/1988 | Warshawsky | 248/122.1 |
| 4,880,193 | A | 11/1989 | Warshawsky | |
| 5,309,334 | A | 5/1994 | Willison | |
| D374,496 | S | 10/1996 | Small et al. | |
| 5,620,247 | A * | 4/1997 | Swanson | 362/250 |
| 5,672,002 | A | 9/1997 | Todd, Jr. | |
| 5,800,054 | A * | 9/1998 | Lo | 362/431 |
| D420,161 | S | 2/2000 | Zuege | |
| D426,336 | S | 6/2000 | Swanson | |
| D434,165 | S | 11/2000 | Hiller et al. | |
| D437,957 | S | 2/2001 | Borders et al. | |
| 6,203,179 | B1 | 3/2001 | Swanson | |
| 6,280,056 | B1 * | 8/2001 | Dolan et al. | 362/250 |
| 6,431,515 | B1 * | 8/2002 | Gampe et al. | 248/324 |
| 6,880,957 | B2 * | 4/2005 | Walters | 362/276 |
| 2003/0141426 | A1 | 7/2003 | Wagner et al. | |

* cited by examiner

*Primary Examiner*—Sandra O'Shea
*Assistant Examiner*—Jacob Y. Choi
(74) *Attorney, Agent, or Firm*—Fulbright & Jaworski L.L.P.

(57) ABSTRACT

A ceiling mounted lighting apparatus having at least a pair of articulated swing arms connected to a support post by a swivle assembly. Each of the swing arms supports a plurality of lamps each of which may be independently adjustable with respect to the swing arm. The support posts carrying the swing arms are braced to carry the weight of the articulated arms and the lamps affixed thereto.

10 Claims, 5 Drawing Sheets

CEILING MOUNTED SWING ARM LIGHTING APPARATUS

BACKGROUND OF THE INVENTION

1. Field of the Invention

This invention relates to lighting apparatus and more particularly to ceiling mounted lighting apparatus.

2. Description of the Prior Art

Lighting apparatus in the form of floor lamps, table lamps, wall mounted lamps and ceiling mounted lamps are well known in the lighting industry. These lighting apparatus take various forms and may include general area lighting, task lighting or a combination of general area and task lighting. It has also been known in the prior art to incorporate one or more swing arms to provide a more versatile positioning of the lighting element. Typically one end of the swing arm is supported by or mounted to a support post, while the other end of the swing arm supports or carries the lighting element of the lighting apparatus. Such swing arm lamps utilize swivel assemblies to mount the swing arm to the support member, thus enabling the swing arm and the lighting elements to be swung about an axis of rotation through the support member. It is also known in floor lamps and table lamps and, in some instances, wall mounted lamps, that a pair of swing arms are connected one to the other by a swivel or swivel assembly to provide even greater versatility for selective positioning of the lighting elements of the lamp in that the swing arms can be selectively positioned with respect to the support post and with respect to each other.

Where a multiplicity of lighting elements disposed upon a ceiling mounted lighting apparatus is desired such has been accomplished by the utilization of track lighting; that is, a track is mounted on the ceiling and the lighting element is then supported within the track and can be positioned laterally along the track to accomplish the desired positioning of the lighting element.

Prior to the present invention, applicant is unaware of any ceiling mounted lighting apparatus which includes a plurality of swing arms which are connected one to the other by a swivel assembly and, in turn, are pivotally connected at one end thereof to a support post extending from a ceiling mount. Attempts in the prior art to provide such a structure have been unsuccessful because the plurality of swing arms and lighting elements connected to each such swing arum was sufficiently heavy to apply a load to the support post causing the support post to bend or the swing arms to droop to such a degree that the structure either became mechanically unsafe or esthetically displeasing.

SUMMARY OF THE INVENTION

A ceiling mounted lighting apparatus which includes a canopy adapted to be affixed to a ceiling fixture and including first and second support posts affixed to the canopy, a first articulated arm is pivotally interconnected to the first support post and a second articulated arm is pivotally interconnected to the second support post with a plurality of lights carried by each of the articulated arms and the apparatus includes means for bracing the first and second support posts to carry the weight of the first and second articulated arms and lights.

DESCRIPTION OF THE PREFERRED EMBODIMENT

Figure 1:
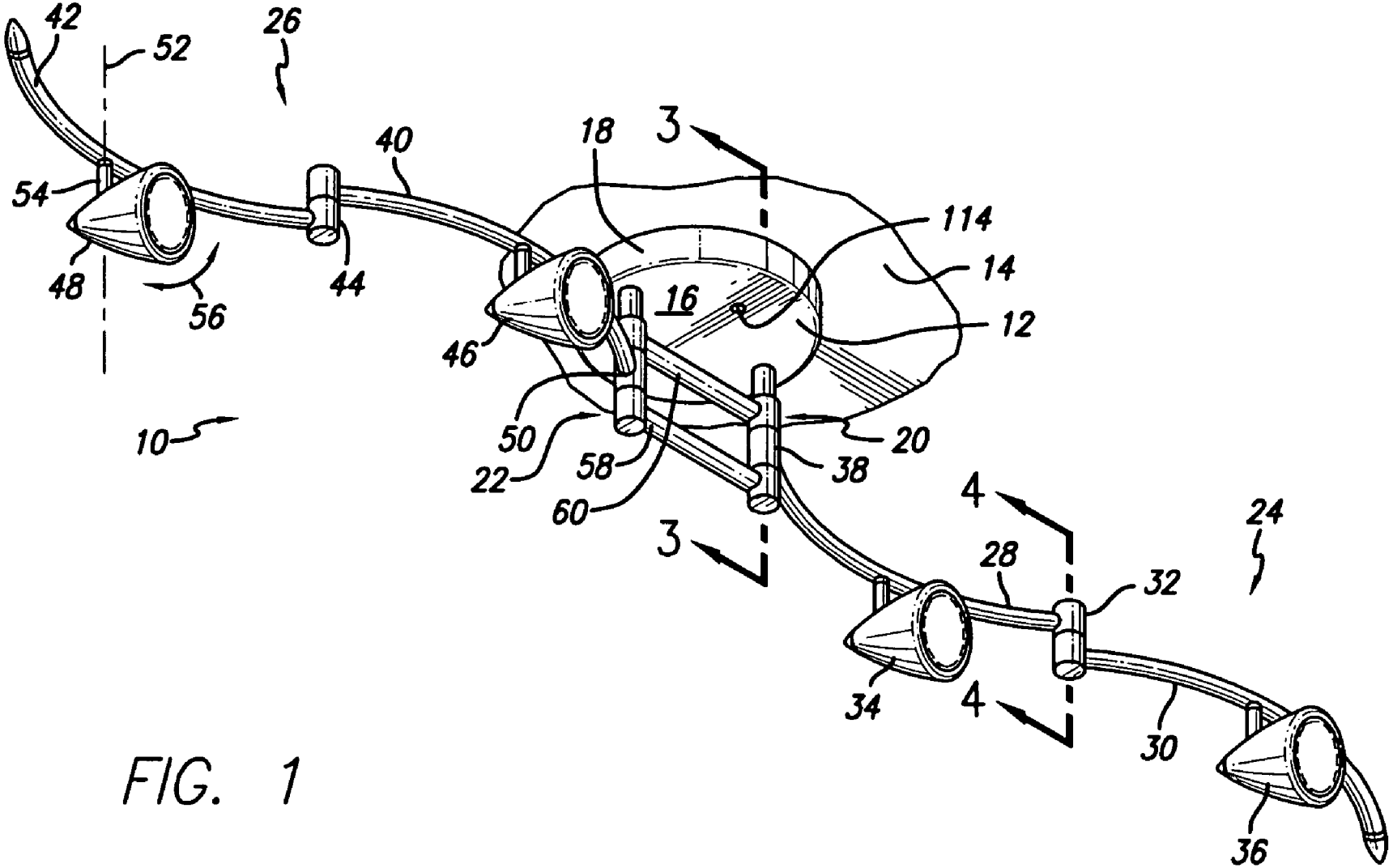
FIG. 1 is a perspective view of the embodiment of the lighting apparatus constructed in accordance with the principles of the present invention.

The ceiling mounted lighting apparatus constructed in accordance with the present invention is specifically directed to a swing arm structure having a plurality of swing arms extending from each of a pair of support posts. The support posts are connected to and extend from a canopy or pan-shaped member which is adapted to be affixed to the ceiling of a residence structure. The swing arms are each articulated in that they include segments, each carrying a separate light and are pivotally connected together by a swivel assembly. The articulated arm is, in turn, connected to the support posts by a swivel assembly. To carry the load of the articulated arms with the associated lights thereon, the support posts include a means for bracing. By reference now to FIG. 1, there is illustrated in perspective view a ceiling mounted lighting apparatus constructed in accordance with the present invention. As is therein shown, the lighting apparatus 10 includes a canopy 12 which is adapted to be connected to a ceiling 14 of a structure typically utilized as a residence, office, or the like. The canopy 12 is in the form of a pan-like structure, having a bottom 16 and a continuous lip or edge 18. A first support post 20 is connected to the bottom 16 of the canopy 12 and extend downwardly therefrom. A second support post 22 is connected to the bottom 16 of the canopy 12 and extends downwardly therefrom. The support posts 20 and 22 are displaced usually in a diametrically opposed manner from each other adjacent the outer perimeter of the canopy 12. A first articulated arm 24 is connected to the support post 20 and extends outwardly therefrom. A second articulated arm 26 is connected to the support post 22 and extends outwardly therefrom. The articulated arm 24 includes segments 28 and 30 which are pivotally connected together by a swivel assembly 32. The arm 28 carries an illumination device such as a lamp 34 while the arm 30 carries an illumination device such as a lamp 36. The articulated arm 24 is connected to the support post 20 by a swivel assembly 38.

The articulated arm 26 includes a first segment 40 and a second segment 42 which are connected together by a swivel assembly 44. The segment 40 carries an illumination device such as a lamp 46 while the segment 42 carries an illumination device such as a lamp 48. The articulated arm 26 is connected to the support post 22 by a swivel assembly 50.

The articulated arms 24 and 26 are typically formed of metal tubes and the lamps are affixed thereto by members 54 also formed of metal tubes that are attached to the arms in such a way that the lamps may be rotated about the axis 52 of the member. The lamps are connected to the member 54 in such a way that the lights may also be manipulated as shown by the arrow 56. It will be understood that although the above description is with respect to the attachment of lamp 48 to the segment 42, such is applicable to each of the remaining lamps 34, 36 and 46. Such rotation about the axis 52 and as shown by the arrow 56 allows positioning of the lamps so as to illuminate any desired area or object. However such rotation and manipulation is limited in rotational extent to prevent damaging the electrical wiring which is carried through the hollow tubes from an appropriate fixture mounted within the ceiling 14 to which the canopy 12 is attached.

To permit the support posts 20 and 22 to carry the load created by the weight of the articulated arms 24 and 26 and the lamps carried by them, a pair of braces 58 and 60 are connected between the support posts 20 and 22. The brace 58 is connected adjacent the lower end of the support posts while the brace 60 is connected adjacent the upper end of the support posts with the swivel assemblies 38 and 50 which support the arms 24 and 26 interposed between the point where the braces 58 and 60 connect to the support posts 20 and 22. As a result of this interconnection, as the weight of the arm 24 causes a clockwise rotational moment to be applied to the support post 20, the forces generated thereby are transmitted by way of the cross brace 58 to the support post 22. In turn, when the weight of the arm 26 causes a counter clockwise rotational moment to be applied to the support post 22 the forces generated thereby are transmitted by way of the cross brace 58 to the support post 20. It will be understood by those skilled in the art that these forces generated by the weight of the two arms 24 and 26 attempting to move the lower ends of the support posts toward each other are effectively compressively absorbed by the cross brace 58 and cancel each other cut, thereby providing a stable apparatus. In a similar fashion the clockwise rotational moment caused by the weight of the arm 24 and the counter clockwise rotational moment caused by the weight of the arm 26 will cause forces generated thereby to be applied to the support posts 20 and 22 respectively and will attempt to move the upper ends of the support posts away from each other. These forces are however absorbed by and effectively cancelled by the cross brace 60 connected between the upper ends of the support posts 20 and 22 thereby further enhancing the stability of the structure.

Figure 2:
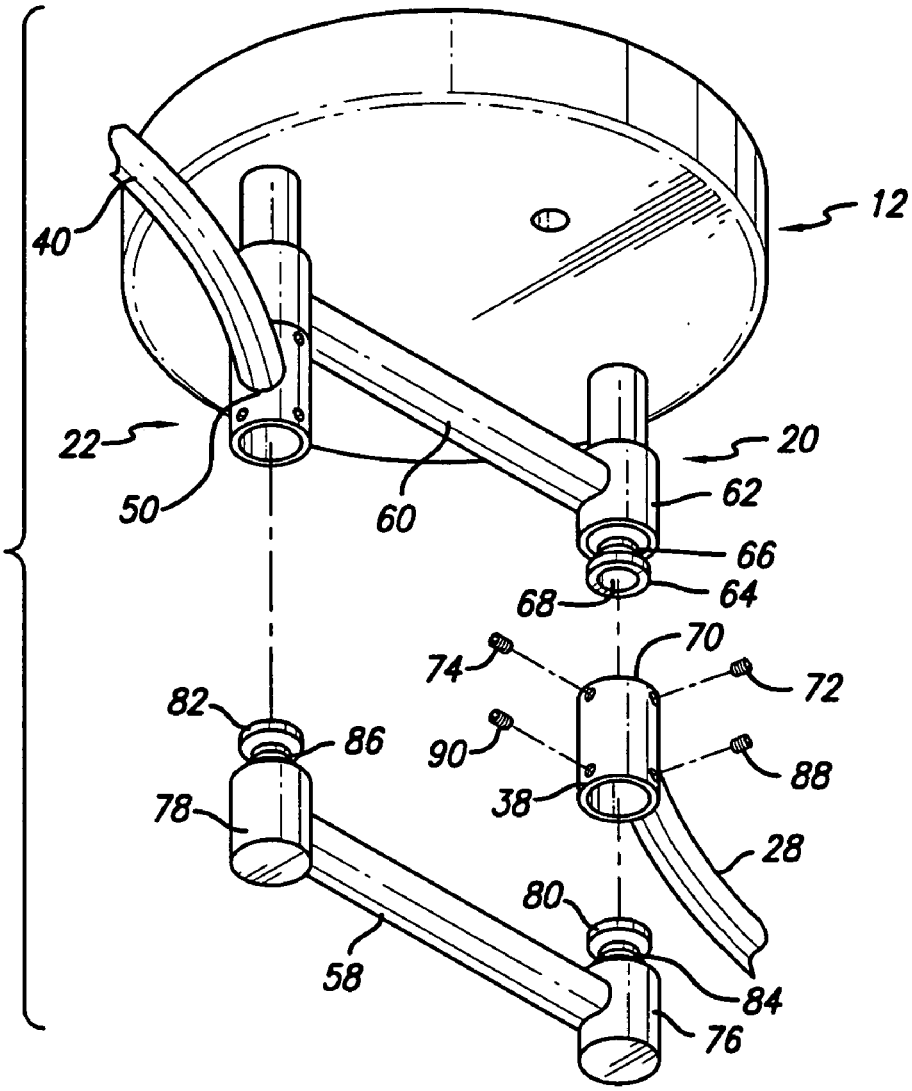
FIG. 2 is a partial exploded view illustrating the support posts and the swivel assembly connecting an articulated arm thereto.

By referring now more particularly to FIG. 2, the support posts and the manner in which the articulated arms 24 and 26 are pivotally secured thereto is shown in greater detail by the exploded view. As is therein illustrated, the support post 20 comprises a tubular element 62 which receives a plug 64 which defines a groove 66 therein. As is illustrated, the plug 64 is hollow as shown at 68 so that approximate electrical wiring may pass therethrough. The connector 38 to which the arm section 28 is affixed is also hollow and the upper end 70 thereof slips over the end of the plug 64. A plurality of threaded elements such as allen screws 72 and 74 or the like are threadably received within threaded openings in the connector 38 and the ends thereof are received within the groove 66 thus affixing the connector 38 to the support post 20 to thereby provide a part of the swivel assembly for the articulated arm 42. At the lower end, there is provided a pair of hollow elements 76 and 78 between which the cross brace 58 is connected. The hollow elements 76 and 78 each receive a plug 80 and 82 formed in a similar manner to the plug 64 to provide an appropriate groove 84 and 86, respectively. Additional threaded elements such as allen screws 88 and 90 are threadably received within threaded openings in the bottom of the connector 38 so that when the connector 38 is slipped over the end of the plug 80, the allen screws 88 and 90 will engage the groove 84 within the plug 80 which thereby completes the swivel assembly supporting the arm 24. A similar structure exists with regard to the support post 22 to provide a swivel assembly for connecting the element 50 which supports the articulated arm 26.

Figure 3:
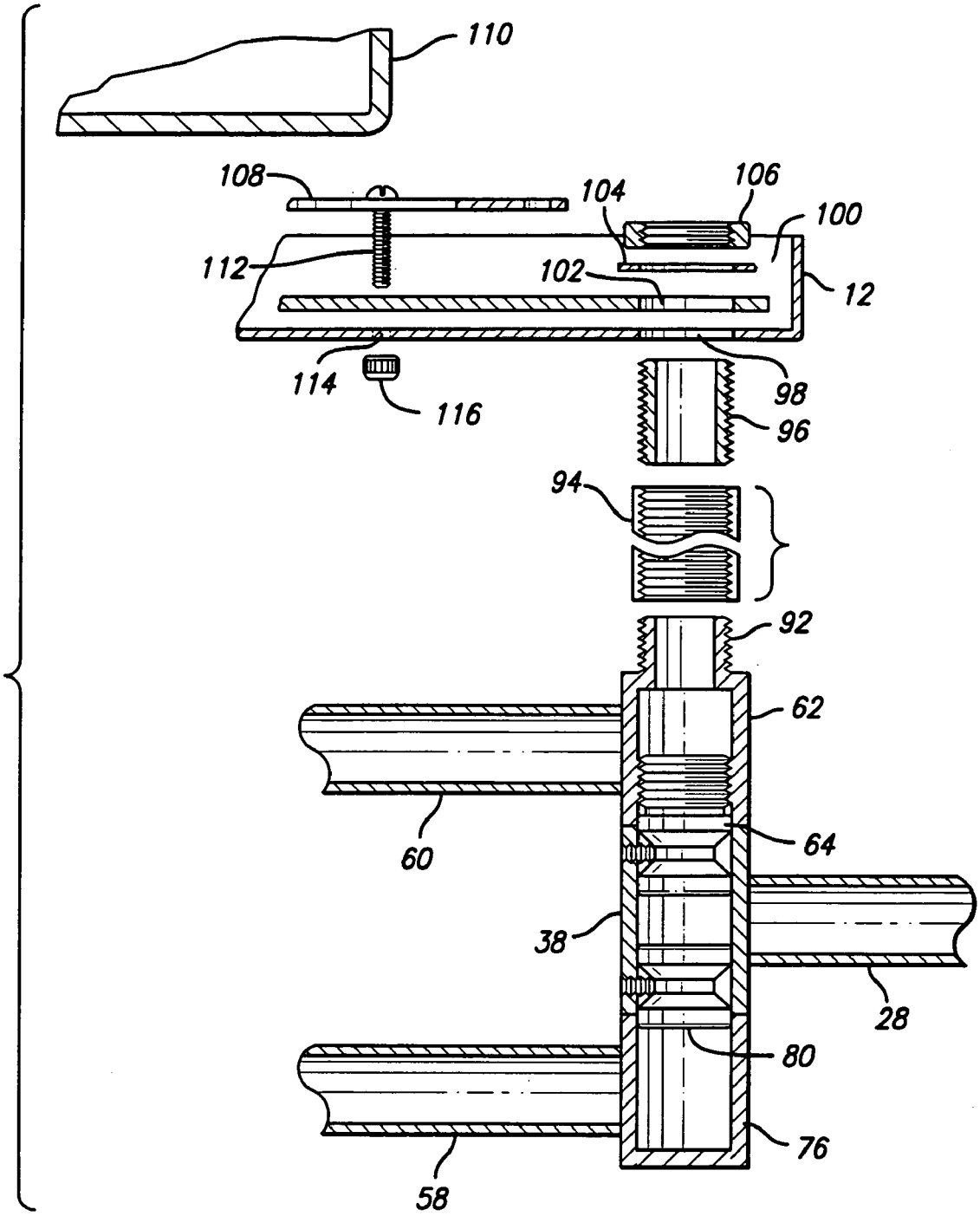
FIG. 3 is a cross-sectional view taken about the lines 3—3 of FIG. 1 illustrating in partial exploded form various components of the lighting apparatus constructed in accordance with the principles of the present invention.

Referring now more particularly to FIG. 3, there is illustrated in partial cross-sectional and exploded view, the manner in which the lighting apparatus constructed in accordance with the present invention is connected to the ceiling. As is therein shown, the member 62 includes a threaded reduced diameter portion 92 which receives in a threaded fashion the lower end of an extension 94. The extension 94 may be of various lengths depending upon how far from the canopy 12 the user wishes the articulated arms 26 and 24 to be. Such is illustrated by breaking the member 94 into two sections. Received within the upper internally threaded end of the element 94 is an externally threaded nipple 96. The nipple 96 extends through an opening 98 in the lower surface 16 of the canopy 12. Disposed internally of the canopy 12 is a reinforcing bar 100 which includes an opening 102 provided therethrough which mates with the opening 98 in the surface 16 of the canopy 12. The threaded nipple 96 extends through the openings 98 and 102 so as to extend to the top surface of the reinforcing bar 100. A lock washer 104 is disposed over the end of the threaded nipple 96 and a threaded nut 106 is secured to the external threads on the nipple 96 to secure the support post 20 to the canopy 12. An adapter ring 108 is secured by screws, bolts or other fasteners to a junction box 110 which is disposed within the ceiling of the structure in which the lighting apparatus is to be utilized. A threaded bolt 112 is threadably received within an opening the adapter ring 108 and extends through an opening 114 in the bottom 16 of the canopy 12. A decorative internally threaded nut 116 is threaded over the end of the bolt 112 to hold the assembly structure as above described securely in place on the junction box 110. A structure similar to that shown in FIG. 3 is duplicated with regard to the support post 22.

Figure 5:
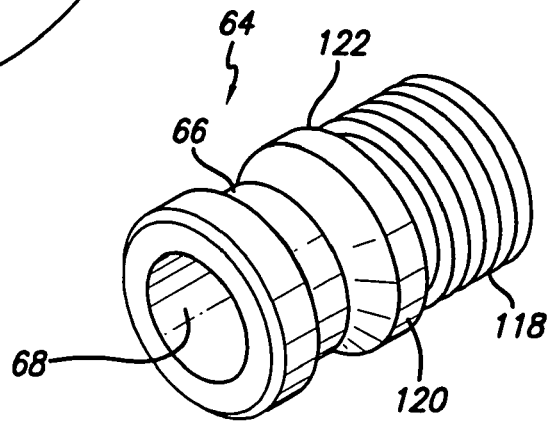
FIG. 5 is a perspective view of a bushing utilized in the swivel assembly.

The plug 64 which is received in the element 62 is further shown in perspective view in FIG. 5 and is threaded in place on internal threads at the lower end of the member 62 the threads 118 being illustrated on the plug 64. The plug also defines a flange 120 which further includes a shoulder 122 which abuts against the lower end of the member 62 when the plug is threaded in place. It should be understood that the plugs such as 64, 80 and 82 may be formed with threads as illustrated in FIG. 5 and threadably secured in place or alternatively, may be smooth surfaced and secured in place by an interference fit.

Figure 4:
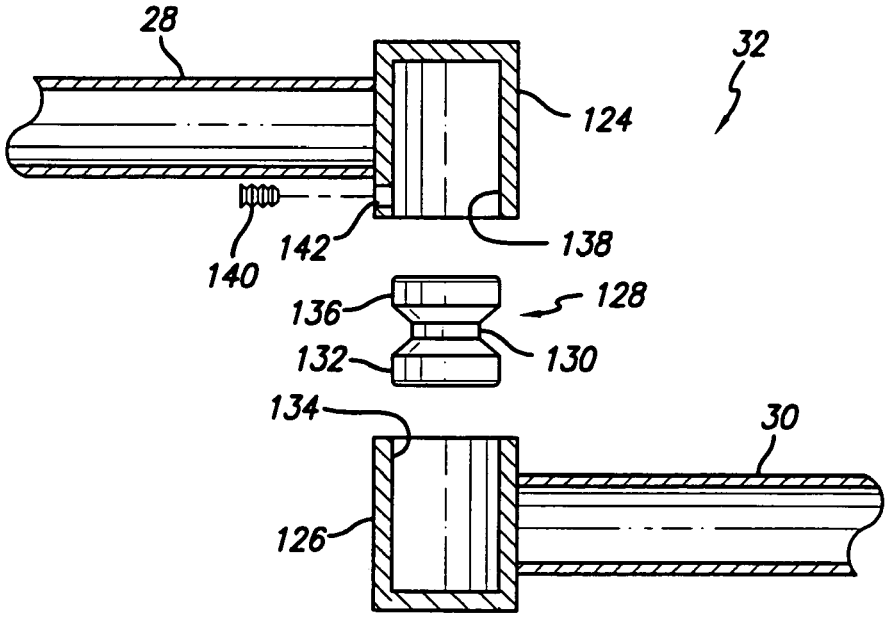
FIG. 4 is a cross-sectional view taken about the lines 4—4 of FIG. 1 illustrating the swivel assembly interconnecting segments of the articulated arm.

Reference is now made to FIG. 4, which illustrates the swivel assembly between sections of the articulated arm 24. As is therein shown, the swivel assembly 32 includes a downwardly directed cup-shaped member 124 connected to the arm 28. Also included is an upwardly directed cup-shaped member 126 which is connected to the arm 30. A plug 128 defines a groove 130 and a through axial opening through which the wiring (not shown) passes. The plug 128 has the lower end 132 thereof press fitted within an opening 134 of the upwardly directed cup-shaped member 126. The upper portion 136 of the plug 128 is slightably received within the opening 138 of the downwardly directed cup-shaped member 124. When in place, a threaded allen a screw or the like 140 is threaded through an opening 142 so that the end thereof is received within the groove 130. As a result, the arms 28 and 30 may be rotated one relative to the other. It should also be understood that the plug 128 may be retained in position within the upwardly directed cup-shaped member 126 by being threaded therein with a plug of the type as shown in FIG. 5.

Figure 6:
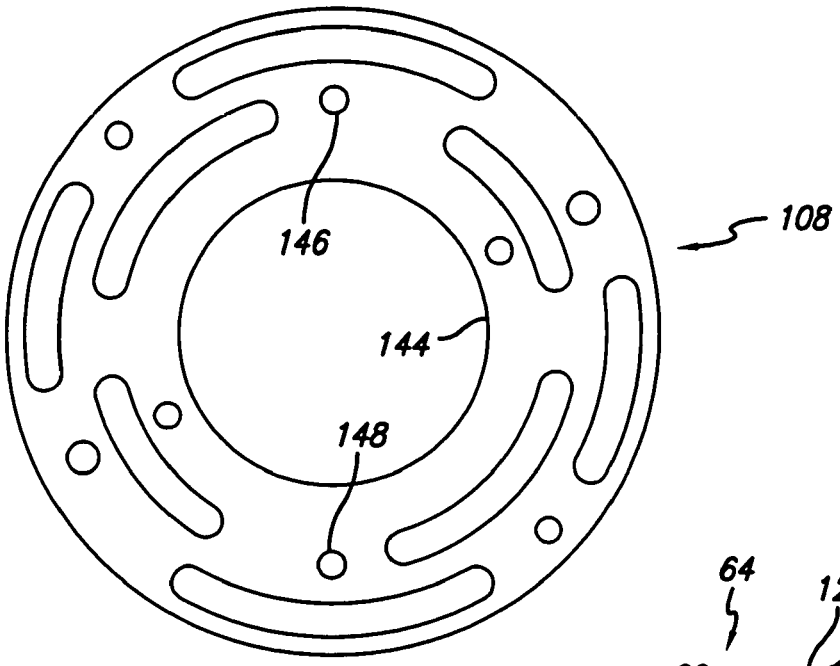
FIG. 6 is a plan view of an adapter plate used in mounting the lighting apparatus of the present invention to a ceiling fixture.

Reference is now made to FIG. 6, which is a plan view of a mounting plate 108 above described in conjunction with FIG. 3. As is therein shown, the plate 108 includes a central opening 144 through which the wiring from the junction box 110 may pass. Threaded openings 146 and 148 are provided to receive the threaded bolts such as illustrated at 112 in FIG. 3. Various other openings are provided as shown to receive appropriate fasteners to secure the mounting plate to the junction box 110 as will be understood by those skilled in the art.

Figure 7:
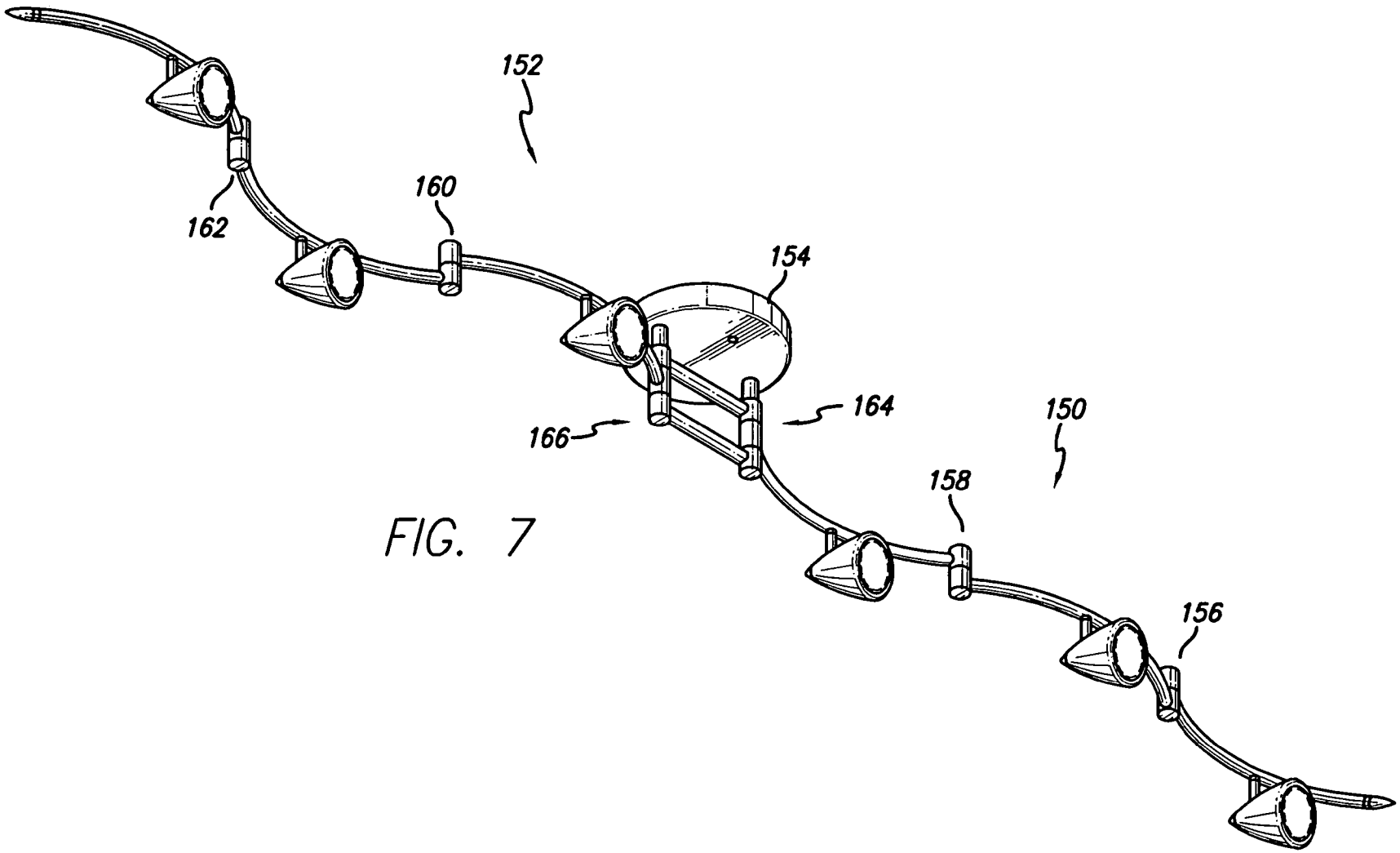
FIG. 7 is a perspective view of an alternative embodiment of a ceiling mounted lighting apparatus constructed in accordance with the present invention.

By reference now to FIG. 7, an alternative embodiment of a ceiling mounted lighting apparatus constructed in accordance with the principles of the present invention is illustrated. As is shown in FIG. 7, each of the articulated arms 150 and 152 which are connected to the canopy 154 contain three distinct segments, each carrying a separate lamp thereon. Each of the segments are connected together by a swivel assembly as shown at 156, 158, 160 and 162. The support posts 164 and 166 which pivotally support the articulated arms 150 and 152 are constructed and operate in the manner above described with regard to the description of the previous embodiment.

There has thus been described a ceiling mounted lighting apparatus having articulated swing arms affixed to support posts which include means for bracing so as to carry the weight of the articulated arms and the lamps which are affixed thereto. While there has been described what is at present considered to be a preferred embodiment of the invention, it will be obvious to those skilled in the art that various changes and modifications may be made therein without departing from the invention as defined in the appended claims. Thus, it will be understood by those skilled in the art that although preferred embodiments have been shown and described, the invention is not limited thereto or thereby since the embodiments of the invention as disclosed and described are presented merely as an example of the invention coming within the proper scope and spirit of the appended claims.

What is claimed is:

1. A ceiling mounted lighting apparatus comprising:

(a) a canopy;

(b) means for affixing said canopy to a ceiling fixture;

(c) a first support post affixed to and extending from said canopy;

(d) a second support post displaced from said first support post, affixed to and extending from said canopy;

(e) a first articulated arm pivotally interconnected with said first support post, said first articulated arm including at least two segments pivotally connected together;

(f) a second articulated arm pivotally interconnected with said second support post, said second articulated arm including at least two segments pivotally connected together;

(g) a plurality of lights carried by each of said first and second articulated arms; and (h) means for bracing said first and second support posts to carry the weight of said first and second articulated arms.

2. A ceiling mounted lighting apparatus as defined in claim 1 wherein said means for bracing includes a first cross brace rigidly connected between said first and second support posts.

3. A ceiling mounted lighting apparatus as defined in claim 2 wherein said means for bracing includes a second cross brace; and means for coupling said second cross brace to said first and second support posts.

4. A ceiling mounted lighting apparatus as defined in claim 3 wherein said first cross brace is disposed above said pivoted interconnection between said articulated arms and said support posts.

5. A ceiling mounted lighting apparatus as defined in claim 3 wherein said second cross brace is disposed below said pivoted interconnection between said articulated arms and said support posts.

6. A ceiling mounted lighting apparatus as defined in claim 4 wherein said second cross brace is disposed below said pivoted interconnection between said articulated arms and said support posts.

7. A ceiling mounted lighting apparatus as defined in claim 3 wherein said second cross brace is disposed below said pivoted interconnection between said articulated arms and said support posts wherein said pivoted interconnections for said first and second articulated arms each includes a reduced diameter member extending from said support posts, said reduced diameter member defining a circumferential groove displaced from a distal end of said support post, a tubular member affixed to an end of each said articulated arm, said reduced diameter member being received within said tubular member and a plurality of threaded cylindrical members threadably carried by said tubular member and extending into said circumferential groove.

8. A ceiling mounted lighting apparatus as defined in claim 3 wherein said second cross brace is disposed below said pivoted interconnection between said articulated arms and said support posts wherein said pivoted interconnections for said first and second articulated arms each includes a first reduced diameter member extending from said support post, said reduced diameter member defining a first circumferential groove displaced from a distal end of said support post, a tubular member affixed to an end of each said articulated arm, said first reduced diameter member being received within said tubular member and a plurality of threaded cylindrical members threadably carried by said tubular member and extending into said circumferential groove; said means for coupling including a second reduced diameter member extending from each end of said second cross brace and defining a second circumferential groove displaced from a distal end thereof, said second reduced diameter member being received within said tubular member and at least some of said cylindrical members extending into said second first circumferential groove.

9. A ceiling mounted lighting apparatus comprising: (a) a canopy adapted for affixing to a ceiling fixture; (b) a first support post affixed to and extending from said canopy; (c) a second support post displaced from said first support post, affixed to and extending from said canopy; (d) a first articulated arm pivotally interconnected with said first support post; (e) a second articulated arm pivotally interconnected with said second support post; (f) a plurality of lights carried by each of said first and second articulated arms; and (g) means for bracing said first and second support posts to carry the weight of said first and second articulated arms, including: a first cross brace rigidly connected between said first and second support posts; a second cross brace; means for coupling said second cross brace to said first and second support posts; said second cross brace being disposed below said pivoted interconnected between said articulated arms and said support posts; and (h) . . . etc.

10. A ceiling mounted lighting apparatus comprising: (a) a adapted for affixing to a ceiling fixture; (b) a first support post affixed to and extending from said canopy; (c) a second support post displaced from said first support post, affixed to and extending from said canopy; (d) a first articulated arm pivotally interconnected with said first support post; (e) a second articulated arm pivotally interconnected with said second support post; (f) a plurality of lights carried by each of said first and second articulated arms; and (g) means for bracing said first and second support posts to carry the weight of said first and second articulated arms, including: a first cross brace rigidly connected between said first and second support posts; a second cross brace; means for coupling said second cross brace to said first and second support posts; said second cross brace being disposed below said pivoted interconnected between said articulated arms and said support posts; and (h) . . . etc.

* * * * *